US011346155B2

(12) United States Patent
Rameil

(10) Patent No.: US 11,346,155 B2
(45) Date of Patent: May 31, 2022

(54) SELF-PROPELLED DRILLING HEAD

(71) Applicant: TRACTO-TECHNIK GmbH & Co. KG, Lennestadt (DE)

(72) Inventor: Meinolf Rameil, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 16/932,195

(22) Filed: Jul. 17, 2020

(65) Prior Publication Data

US 2021/0025234 A1 Jan. 28, 2021

(30) Foreign Application Priority Data

Jul. 24, 2019 (DE) ..... 10 2019 005 132.7

(51) Int. Cl.
*E21B 4/02* (2006.01)
*E21B 10/26* (2006.01)
*E21B 10/62* (2006.01)

(52) U.S. Cl.
CPC ..... *E21B 4/02* (2013.01); *E21B 10/26* (2013.01); *E21B 10/62* (2013.01)

(58) Field of Classification Search
CPC ..... E21B 10/26; E21B 10/40; E21B 10/62; E21B 4/02; E21B 4/145; E21B 7/26
See application file for complete search history.

(56) References Cited

U.S. PATENT DOCUMENTS

| | | | | |
|---|---|---|---|---|
| 3,797,586 | A | 5/1974 | Coyne et al. | |
| 4,100,980 | A * | 7/1978 | Jenne | E21B 4/145 173/132 |
| 5,226,487 | A * | 7/1993 | Spektor | E21B 4/145 173/133 |
| 7,093,677 | B2 * | 8/2006 | Hofmann | E21B 4/145 175/62 |
| 2013/0025936 | A1 * | 1/2013 | Puttmann | E21B 17/03 175/19 |
| 2017/0334052 | A1 * | 11/2017 | Puttmann | B25D 9/26 |

FOREIGN PATENT DOCUMENTS

| | | |
|---|---|---|
| DE | 37 24 619 A1 | 2/1989 |
| DE | 101 12 985 A1 | 10/2002 |

* cited by examiner

*Primary Examiner* — Caroline N Butcher
(74) *Attorney, Agent, or Firm* — Howard IP Law Group, PC

(57) ABSTRACT

A self-propelled drilling head for drilling in soil by means of a multi-stage method comprises the drilling head having a housing and a drilling head tip arranged in the housing, and a spacer provided on the drilling head tip, by means of which the drilling head tip is in contact with the housing in order to change the multi-stage method to a method with a reduced number of stages.

8 Claims, 2 Drawing Sheets

SELF-PROPELLED DRILLING HEAD

FIELD OF INVENTION

The invention relates to a self-propelled drilling head for drilling in soil by means of a multi-stage process, a use of a spacer in a self-propelled drilling head and a method for retrofitting a self-propelled drilling head for drilling in soil.

BACKGROUND

In the field of ground drilling devices, self-propelled drilling heads in the form of ram drilling devices or rocket drills are known, with which ground drilling can be carried out. The self-propelled drilling heads usually have a drilling head tip designed as a chisel, which is arranged in a housing and is acted upon by a percussion piston at the end, wherein the drilling head tip can be arranged in the housing in a longitudinally movable manner.

A distinction is made between self-propelled drilling heads which operate as one-stage or one-cycle, those as two-stage or two-cycle, and those as three-stage or three-cycle devices. More than three stages or cycles are possible, but not common. With a one-cycle device, the percussion piston hits the tip of the drilling head and, at the same time, the housing. In the case of a multi-cycle device, in particular a two-cycle device, the percussion piston first strikes the tip of the drilling head, which runs ahead in the first cycle. The housing is struck by the percussion piston directly or indirectly only in a subsequent cycle, in particular in the second cycle.

A striking head is known from DE 101 12 985 A1, which has a chisel with a striking tip for contacting the ground at one end and an anvil for striking by means of a striking piston at the other end. The chisel is arranged in a bore in a base, which also serves as an adapter for screwing into a striking device body.

Although very good results are achieved with the known drilling heads, it has so far not been possible for a user to retrofit a drilling head for a different timing or for a different staged operation. So far, the user has had to use a completely different drilling head, which requires the purchase of at least two drilling heads. This means that in the case of geological formations, in particular homogeneous, sandy soils, where a rigid head (one-stage or one-cycle method) offers advantages, the system must be completely replaced for a drilling head other than the drilling head with a movable drilling head tip.

SUMMARY

The object of the invention is to be able to use a self-propelled drilling head more flexibly by the user, which means a significant added value for the user.

The object is achieved by the subject matter of the independent claims. Advantageous embodiments are the subject of the respective subclaims and the description.

The invention relates to a self-propelled drilling head for drilling in soil by means of a multi-stage method, the drilling head having a housing and a drilling head tip arranged in the housing, and a spacer is provided on the drilling head tip, by means of which the drilling head tip is in contact with the housing in order to change the multi-stage method to a method with a reduced number of stages.

The main idea of the invention is to provide a retrofittable drilling head in which the longitudinally movable or axial movement possibility of a drilling head tip in the housing is reduced or prevented in order to substantially secure the drilling head tip in the housing. In this way it can be achieved that in particular the step when the percussion piston hits the drilling head tip and only later the drilling head tip in turn hits the housing will take place together and essentially at the same time the percussion piston will act on the housing indirectly or directly via the drilling head tip. Securing the drilling head tip in the housing so that the drilling head tip is in contact with the housing reduces the number of steps. A possible microscopic movement in the longitudinal axial direction is of no account here. It is important that the longitudinal axial mobility be reduced.

The invention has abandoned the preconceived notion that a component is required for a securing and thus a reducing of the number of stages or the number of cycles, one which requires very tight and therefore expensive manufacturing tolerances, so that no play of the drilling head tip can occur. In particular, the preconceived notion was abandoned that even a very slight play of such a component will result in damage or destruction due to the continuous impact action. In the industry, it was not considered possible to secure the drilling head tip. The invention now provides a spacer by means of which the drilling head tip is in contact with the housing in order to bridge the distance between the drilling head tip and the housing that is usually present in a multi-stage process. Thanks to the contact, especially the direct contact, between the drilling head tip and the housing by means of the spacer, the impact action of the percussion piston is also transmitted to the housing directly in the cycle or the stage in which the percussion piston hits the drilling head tip.

In this way, the user can focus on the drilling head tip covering the main area of application in the procurement process, namely a multi-stage process, and can obtain a drilling head by means of a simple retrofitting that works according to a different stage or cycle process, i.e., in a reduced stage or cycle process. In the sense of the description, a reduction in the steps or a reduction in the cycles is not only a complete elimination of a stage or a cycle, but involves in particular a reduction or a decreasing of the longitudinal mobility of the drilling head tip relative to the housing. Although preventing the mobility of the drilling head tip relative to the housing is desired, a reduction in the mobility is sufficient to assume a reduction in the number of stages or cycles. In particular, when the drilling head tip is secured, the distance from mutually directed stop surfaces of the drilling head tip and the housing, which cooperate in a multi-stage process and are pressed apart in particular by means of a spring, can be reduced or minimized or even completely eliminated, so that the impact energy of the percussion piston on the end of the drilling head tip can be transmitted substantially directly to the housing via the stop surfaces of the drilling head tip and housing, particularly when they are in contact, without the drilling head tip running ahead—possibly with an adapter. A longitudinal mobility of the drilling head tip in the millimeter range, in particular 1 mm to 5 mm, which is usually provided in a multi-stage process, can be reduced to 0 mm to 1 mm, particularly preferably 0 mm to 0.75 mm, especially particularly preferably 0 mm to 0.5 mm, further particularly preferably 0 mm to 0.4 mm, very particularly preferably 0 mm to 0.3 mm. In a particularly preferred embodiment, the longitudinal mobility between the drilling head tip and the housing can be reduced or decreased to substantially 0 mm by means of the spacer. By means of the spacer, the drilling head tip can be in constant contact with the housing during operation by means of the associated stop surfaces.

The invention provides a self-propelled drilling head for drilling in soil by means of a multi-stage process, the drilling head having a housing and a drilling head tip arranged in the housing, and a spacer being provided on the drilling head tip, by means of which the drilling head tip is in contact with the housing, in order to change the multi-stage method to a method with a reduced number of stages.

The term "soil" in the sense of the present description includes in particular any type of material, in particular earth, sand, rock, stone and mixed forms thereof, in which existing or yet to be created, preferably at least partially horizontal, channels or boreholes can be made, in particular earth channels including earth boreholes, rock drilling or underground conduits as well as underground or above-ground pipelines and water channels, which can be produced or pulled in by using a suitable device for drilling in the soil.

A "device for drilling in soil" is understood to mean any device that moves a drill string with rod sections in an existing or yet to be created channel in the ground in order to create or expand a hole, in particular a horizontal hole (HD), or to pull pipelines or other long bodies into the soil. The device for drilling in soil can in particular be an HD device. A device for drilling in soil can thus be a device that drives a drill string, which works to displace the soil, and introduces the drill string into the soil in a translational and/or rotary manner in the longitudinal axial direction of the drill string. A borehole can be drilled into the ground by applying tension or pressure to the drill string.

The term "HD" (horizontal drilling) in the sense of the present description includes in particular an at least partially horizontally arranged borehole or channel or pipeline.

The term "self-propelled drilling head" encompasses a drilling head that is designed in the form of a ram drilling device or rocket drill. The term rocket drill is used essentially synonymously with the term ram drilling device. In the sense of the description, the self-propelled drilling head comprises a self-propelled striking device which works to displace the earth and which can introduce a borehole, a conduit and/or a pipe into the soil. The term "self-propelled drilling head" encompasses earth displacement devices in which the drilling head tip can be arranged in a longitudinally movable manner in a housing and can be acted upon at the end by a percussion piston. The drilling head tip can in particular be a chisel. A self-propelled drilling head can in particular be a two-stage or two-cycle device. An embodiment of the self-propelled drilling head as a three-stage or three-cycle device is also possible. In the case of the devices, a distinction is made in the steps or cycles according to the order or sequence in which a percussion piston hits the tip of the drilling head and the housing.

With a one-cycle device, the percussion piston hits the tip of the drilling head and, at the same time, the housing. In the case of a multi-cycle device, in particular a two-cycle device, the percussion piston first strikes the tip of the drilling head, which runs ahead in the first cycle. The percussion piston acts on the housing in a subsequent cycle, in particular in the second cycle. In a multi-stroke device, tip resistance and skin friction are separated and are easier to overcome alternately. With a multi-stroke device, in particular a two-stroke device, better energy conversion can take place, which in particular facilitates the fragmenting of obstacles due to the concentration of the percussion pulse at the tip of the drilling head. As a result of the earth displacement running ahead of the drilling head tip along the stroke path, the housing remains in a position of rest and thus ensures relatively good running stability.

The term "drilling head tip" in the sense of the description is an element on the drilling head side which has an outwardly directed or exposed end which comes into contact with the soil during drilling. The tip of the drilling head forms the front area of the drill string that first comes into contact with the earth to be displaced when the earth borehole or conduit is introduced into the soil. The outward end of the drilling head tip can have a percussion tip, which can in particular have a stepped geometry and preferably has a cutting edge. The drilling head tip can have a non-tapering front-end geometry. The drilling head tip can in particular be a chisel. The drilling head tip can have an end facing a percussion piston on which the percussion piston can strike (end of the drilling head tip on the anvil side). The drilling head tip can have an adapter axially fixed with respect to the drilling head tip, in particular a stepped adapter. As an alternative or in addition, the drilling head tip can have an adapter which can be displaced axially with respect to the drilling head tip, in particular a stepped adapter. The drilling head tip can be pretensioned in the housing by means of a spring, in particular in an annular space between the drilling head tip and the housing, in order to hold the drilling head tip in its basic position or to move it back into it. The drilling head tip can be an element with which the displacement work of the device for drilling in soil can be carried out in front of the drill string. The drilling head tip is not necessarily made in one piece. The drilling head tip can also be formed from several segments which are arranged one behind the other in the longitudinal direction. In a preferred embodiment, the drilling head tip is formed in one piece at least in the region of the housing. If there are adapters on the drilling head tip, they can be designed as detachable adapters.

The housing in the sense of the description can be tubular at least in sections. The housing can have any desired cross-section, which in particular can be round, circular and/or elliptical. The housing preferably has a channel which extends longitudinally through the housing and in which the drilling head tip can be arranged. The longitudinal extension of the housing and the longitudinal extension of the drilling head tip can correspond to each other. A percussion piston can also be arranged in the housing, in particular if the device for drilling in soil is a ram drilling device. It is possible that the housing in which the drilling head tip and/or the percussion piston can be arranged can be connected to a further housing (a rear housing) in which the percussion piston—in the case of a ram drilling device—is arranged. In the event that the housing is connected to a further (rear) housing, for example by mounting a percussion piston which can act on the drilling head tip, a structuring for the connection can be provided on the housing for the drilling head tip, especially at the end, which is formed corresponding to a structuring on the housing for the percussion piston. The term housing can encompass a solid casing, in particular made of metal, in particular steel, surrounding the drilling head tip on the circumference at least for a section. The housing can in particular be part of a housing of a ram drilling device which can be connected to the housing in which the percussion piston is arranged. In this sense, the housing can be a so-called front housing, which can be connected to the housing for the percussion piston, for example by means of screwing, gluing, shrink fitting, welding or a combination of the aforementioned methods. If the housing is a section of a housing which can be connected to the housing in which the percussion piston is arranged, the housing in the connection region can have a smaller cross section than the housing in which the percussion piston is arranged. The housing in which the drilling head tip is arranged can be inserted into the housing in which the percussion piston is arranged. If the housing in which the drilling head tip is arranged is inserted into the housing in which the percussion piston is arranged, the insertion can result in the drilling head tip also being arranged—at least at the end or in part—in the housing where the percussion piston is arranged.

In the sense of the description, the term "spacer" comprises an element for bridging a spacing or a distance between the housing and the drilling head tip. The spacer can in particular be disc-shaped and it can be designed as a spacer; however, in contrast to the consideration commonly associated with the term "spacer", that a very precise and exact production is necessary, a time-consuming and cost-intensive adaptation is not necessary. The term "spacer" is used synonymously here for an element bridging a spacing between the drilling head tip and the housing. The spacer can in particular be used to reduce or eliminate a spacing provided between the associated stop surfaces on the drilling head tip and the housing. The distance or the spacing can in particular be bridged through a pretensioning which can keep the stop surfaces at a distance or spacing. The term "spacer" also includes a material that is initially at least partially not "piece-like" or spatially fixed, and said material can be arranged at the tip of the drilling head in order to reduce the distance or the spacing between the stop surfaces. In this respect, the spacer can, for example, be formed at least partially by filling and curing an initially non-solid, in particular liquid or fluid material, as needed. If it is described in the description that a spacer is formed at least partially by means of a non-solid material, this means that in addition to the non-solid material an additional material, especially a solid material or another non-solid or solid material can be used for the formation.

By means of the spacer, the drilling head tip can be secured or clamped in the housing in a front position against the spring loading. While the spring can separate by means of the spring force the drilling head tip from the portion of the housing that can be struck by the drilling head tip, the spacer causes a securing or jamming of the drilling head tip in a forward position. The front position can be a position of the drilling head tip in which the drilling head tip is at a greater distance from the percussion piston or a distance of the drilling head tip from a section of the housing which can be struck by the drilling head tip is reduced or minimized. The drilling head tip can be pulled out of the housing and the spacer inserted to hold the drilling head tip in the forward position against the action of the spring loading. The spacer can clamp the drilling head tip on the circumference by means of a press fit, wherein the spacer is pressed around the drilling head tip and the spacer lies against the housing at the rear (facing away from the exposed end of the drilling head tip or facing the percussion piston).

In a preferred embodiment, the housing has a receiving space in which the drilling head tip can be arranged. As a result, a mounting of the drilling head tip can be provided at a defined point, in which a longitudinal movement of the drilling head tip in the housing can be possible. In a preferred embodiment, the receiving space surrounds the drilling head tip at least for a section on the circumference, so that there is a longitudinal axial guidance. The receiving space can be an easily produced space that can be formed, for example, by means of a recess in the housing. For example, the receiving space can be formed by means of turning, milling, drilling, spark erosion, etc.

The housing with the drilling head tip can be covered or closed at the front by an adapter arranged on the drilling head tip. Such an adapter can be attached to the drilling head tip at a predetermined position by means of one or more fastening bolts. An adapter that covers the receiving space on the front can grip around the housing on the front. A seal can be present between the housing and the adapter, which creates a seal against particles and/or fluid in the contact area between the housing and the adapter. This can ensure, for example, that no dirt or the like can penetrate into the receiving space.

In a preferred embodiment, a bearing can also or alternatively be provided for guiding in the housing, especially a bushing-like bearing, which is designed, for example, as a sliding bushing. The bearing can be a tubular component which is arranged in the receiving space, in particular in a front area of the receiving space, and which receives the drilling head tip in a substantially precise fit. Simple handling and manufacture of the device can be achieved by the bearing being formed in one piece in the form of a bushing. The entire bearing as such can be easily removed and easily put back again. The bearing can in particular be arranged in the receiving space in such a way and designed such that only sliding surfaces for the drilling head tip are exposed. In particular, the bearing can be designed without a stop surface that has an orientation transverse to the longitudinal axis of the drilling head tip. The drilling head tip and bearing can only have contact surface pairs which are aligned essentially along the longitudinal axis of the drilling head tip. One end of the bearing facing the percussion piston can be present in the receiving space without striking a further element of the drilling head, in particular the drilling head tip. The bearing can essentially only be acted upon or come into contact with outer surfaces of the drilling head tip oriented along the longitudinal axis of the drilling head tip.

In a preferred embodiment, the bearing comprises a different material from the tip of the drilling head. For example, it can be provided that the material for the bearing is selected to be "softer" than the material of the drilling head tip, so that the wear occurs predominantly on the bearing. In a preferred embodiment, the bearing comprises bronze, i.e., a tin alloy, white metal, i.e., a lead-tin alloy, a bearing metal alloyed with lead, an aluminum alloy, a plastic, for example PTFE, a ceramic, which can be fiber-reinforced, or a brass alloy. There is great experience with the above-mentioned materials, so that the handling can be simplified.

In a preferred embodiment, the spacer rests on a front area of the housing. This may allow easy access to the drilling head tip. The arrangement on the housing at the front eliminates the need for tedious retrofitting measures and/or disassembly of the drilling head. For example, the spacer can be arranged in an area in which the drilling head tip emerges from the housing.

In a preferred embodiment, the drilling head tip is prestressed by means of the spacer. In this way it can be achieved that the spacer exerts a force on the drilling head tip, which causes the drilling head tip in the housing to be deflected in relation to a normal position in the multi-stage process. A compression spring provided for the possible return of the drilling head tip to the starting position after being acted upon by the percussion piston can be deflected from its "rest position", in which no force acts on the compression spring, by means of the spacer; the drilling head tip is then in its "rest position" also in a different position compared to the multi-step process. The compression spring can thus be brought into an initial position by means of the spacer, wherein the compression spring has a shorter length than in the case in which the spacer is not present.

In a preferred embodiment, the spacer comprises an elastic plastic. In this way, in addition to the core idea of the invention, a very narrow and therefore expensive manufacturing tolerance can be dispensed with. The elasticity of the spacer can be used with a slight oversizing to secure the drilling head tip and/or to deflect it from the rest position as compared to the multi-step method. The elasticity allows a spacer with a larger manufacturing tolerance to be installed and still secure the tip of the drilling head. A possible material for the spacer is a plastic, in particular polyurethane. The plastic can be fiber and/or metal reinforced. It is also possible to introduce an elastic filler or plastic that hardens and forms part or all of the spacer. A spatially fixed shape of the spacer can simplify the removal of the spacer. An initially non-spatial solid material, which only assumes or maintains the spatial shape after hardening, can offer the advantage that the spacer can be easily adapted to different sizes of drilling head tips and/or housing.

In a preferred embodiment, the spacer is arranged in an intermediate area between the housing and an adapter. In this way, a particularly simple type of retrofitting can be produced by removing the adapter, adding the spacer at the front end of the housing, and putting the adapter back on. The invention thus creates not only a possibility of retrofitting, but also a simple configuration of the retrofitting.

In a preferred embodiment, the spacer is arranged in a ring around the tip of the drilling head, so that a particularly simple configuration of the spacer can also be present. This can also improve the handling. The spacer can engage in a ring on the drilling head tip and attach to the original configuration of the drilling head tip without any change. A ring-shaped configuration of the spacer enables self-centering and simple retrofitting or mounting of the spacer.

In a preferred embodiment, the spacer can be formed in one or more parts. A multi-part design of the spacer enables the spacer to be adapted to different sizes of drilling head tips.

The invention also provides use of a spacer in a self-propelled drilling head. The drilling head is designed for drilling in soil according to a multi-stage process. The drilling head has a housing and a drilling head tip arranged in the housing. The spacer is used at the tip of the drilling head. By means of the spacer, the drilling head tip is in contact with the housing and the drilling head is used in a cycle process, which is reduced by one cycle compared to the multi-cycle process.

The comments on the aspect of the drilling head tip also apply to the aspect of use, such that the comments on the two aspects complement each other.

The invention also provides a method for retrofitting a self-propelled drilling head for drilling in soil in accordance with a multi-stage process. The drilling head has a housing and a drilling head tip arranged in the housing. The housing is opened and a spacer is inserted, the housing then being closed again. The spacer is in contact with the drilling head tip and housing to reduce the multi-stage process in terms of its stages The comments on the aspect of the drilling head tip also apply to the aspect of the method for retrofitting a self-propelled drilling head.

In the sense of the description, the naming of a numerical value includes not only the actual numerical value, but also—in order to take into account manufacturing tolerances in particular—a range around the specific numerical value that can be +/−15%, preferably +/−10%, of the specified numerical value.

In the sense of the description, the term "comprise" encompasses both the meaning contained in the term that further elements can be provided in addition to the elements mentioned (non-exhaustive list), but also the meaning that the term "comprise" is used synonymous with "consist of" or "formed from".

The following description of exemplary embodiments, like the preceding statements, do not constitute an abandonment of specific embodiments or features.

BRIEF DESCRIPTION OF THE DRAWINGS

The invention is explained in more detail below using an exemplary embodiment shown in the figure.

The drawings show.

DETAILED DESCRIPTION

Figure 1:
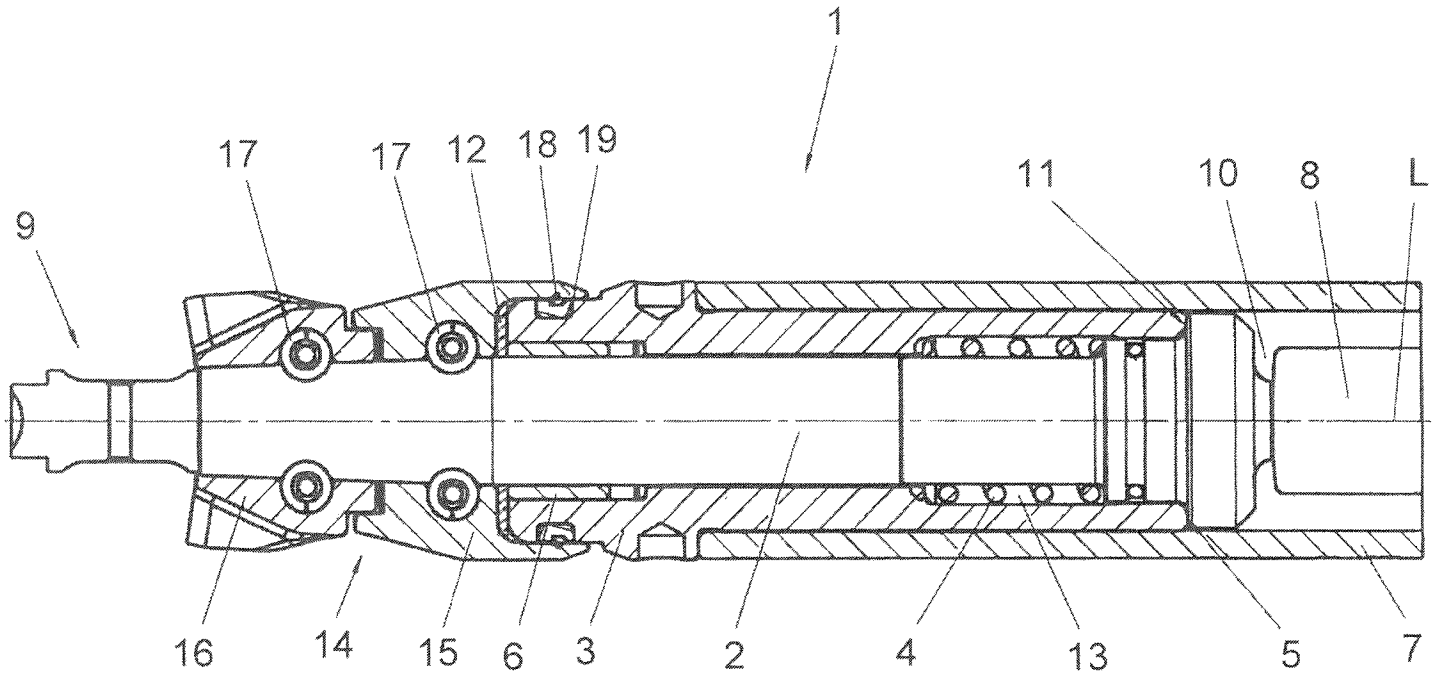
FIG. 1 illustrates a front portion of a drilling head for drilling in soil in a partially sectioned view.

FIG. 1 shows a partially sectioned illustration of a front area of a drilling head 1 for drilling in the soil. The drilling head 1 has a drilling head tip 2 and a housing 3, in which the drilling head tip 2 is arranged. A bearing 6 is provided in the housing 3, in which the drilling head tip is mounted. Basically, the drilling head tip 2 is held in the housing 3 in a longitudinally movable manner along the longitudinal axis marked with L. A compression spring 4 is provided between the housing 3 and the drilling head tip 2, by means of which the drilling head tip 2 is kept at a distance from a stop surface 5 on the housing 3.

The housing 3 is used as a front housing in a housing 7 in which a percussion piston 8 is arranged. The drilling head tip 2 has an exposed end 9 which can come into contact with the ground. At the end 10 opposite the end 9 of the drilling head tip 2 exposed to the soil, an anvil is formed at the end, which can be acted upon by the percussion piston 8.

Figure 2:
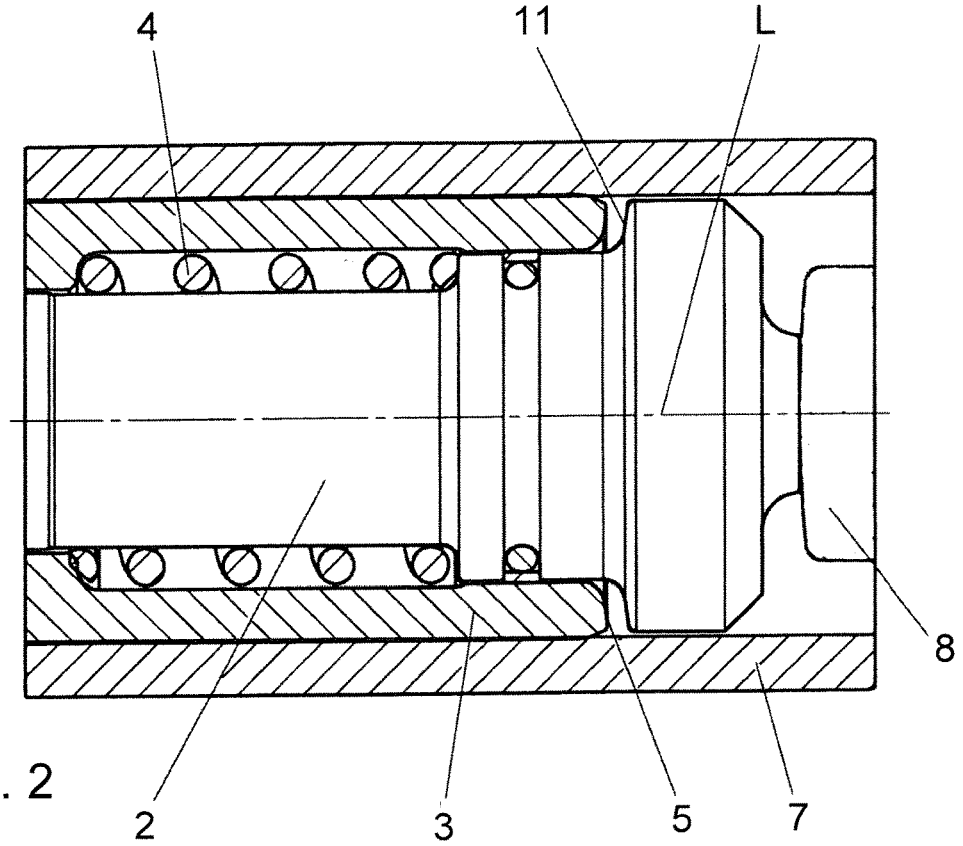
FIG. 2 illustrates a detailed view of FIG. 1.

The illustrated drilling head 1 can be operated in several operating modes, which differ in terms of the stages or timing. In the multi-stage process, the percussion piston 8 hits the anvil of the drilling head tip 2 at the end 10, so that the drilling head tip 2 is first moved until the drilling head tip 2 meets the stop surface 5 of the housing 3 by its stop surface 11 (see also here FIG. 2). Only then is the entire drilling head 1 driven forward by the residual impact energy of the percussion piston 8 via the housing 3. During the backward movement of the percussion piston 8, the drilling head tip 2 is returned to the starting position by the compression spring 4.

Figure 3:
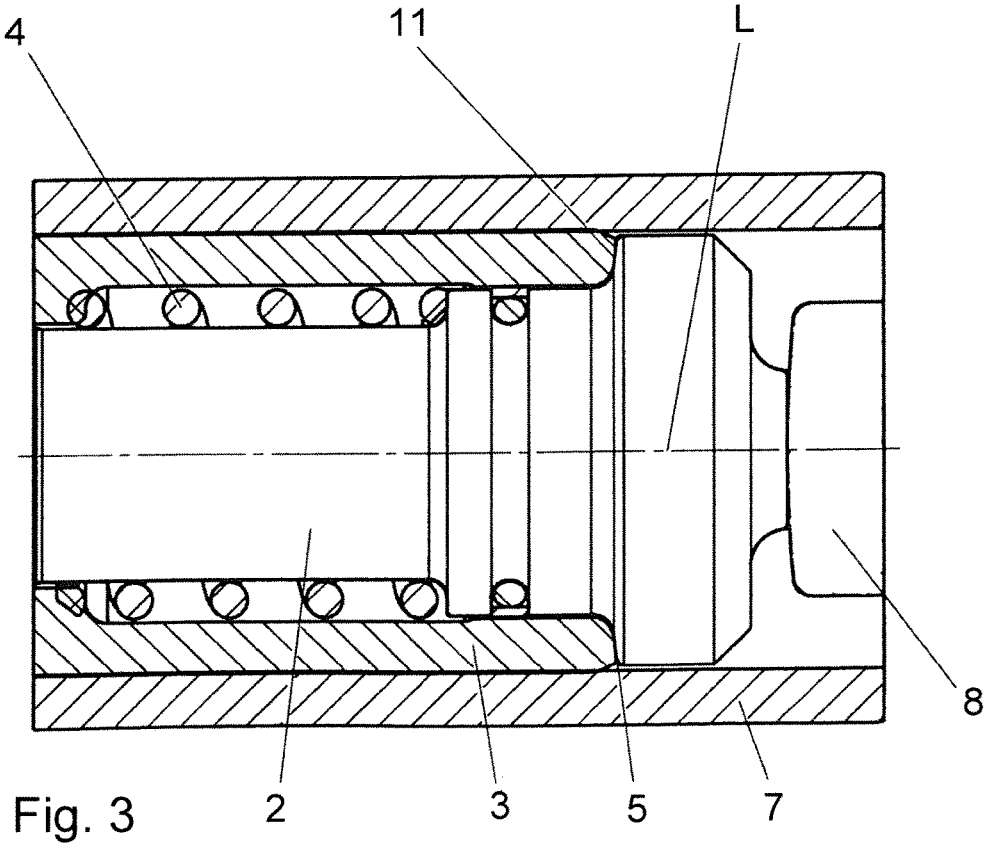
FIG. 3 illustrates the detailed view of FIG. 2 in the retrofitted state.

In order to change the multi-stage method, a spacer 12 is provided, by means of which the drilling head tip 2 can be brought into contact with the housing 3. While the spacer 12 is not present in the multi-stage process (FIG. 2), the spacer 12 brings about a reduction in the number of stages or the number of cycles. By securing the drilling head tip 2 in the housing 3, the longitudinal mobility of the drilling head tip 2 relative to the housing 3 is reduced and, when the impact piston 8 strikes the end 10 of the drilling head tip 2, the housing 3 is driven forward indirectly via the drilling head tip 2. The spacer 12 holds the compression spring 4 under increased continuous tension and compensates for the play between the stop surface 5 of the housing 3 and the stop surface 11 of the drilling head tip 2. The spacer holds the stop surface 5 of the housing in contact with the stop surface 11 of the drilling head tip 2 (FIG. 3). If the percussion piston 8 thus strikes the end area of the drilling head tip 2 configured as an anvil, the entire impact energy of the percussion piston 8 is transmitted substantially directly via the housing 3 in order to move the entire drilling head 1 forward. By means of the spacer 12, the drilling head 1 shown in FIG. 1 is designed for the one-step process.

In the embodiment shown in FIG. 1, the drilling head tip 2 is arranged in the receiving space 13 of the housing 3, the receiving space 13 having an oversize compared to the circumference of the drilling head tip 2. The drilling head tip 2 is contacted by means of the bearing 6, which ensures the entire mounting of the drilling head tip 2 in the housing 3.

For easy access or a simple retrofitting option of the drilling head 1 shown in FIG. 1, the drilling head 1 has at the front end of the housing 3 an adapter 14 attachable to the housing 3, which is designed in two parts in the illustrated embodiment. The first part 15 of the adapter 14 covers the front area of the housing 3. The first part 15 of the adapter 14 can be fixed or secured on the drilling head tip 2 by means of dowel pins 17. For sealing between the first part 15 of the adapter 14 and the housing 3, an annular circumferential seal 18 is provided in the housing 3, which is arranged in a corresponding groove 19 in the housing 3. A second part 16 of the adapter 14 is also fixed or secured on the drilling head tip 2 by means of dowel pins 17. The second part 16 of the adapter 14 has cutting edges.

The invention claimed is:

1. A self-propelled drilling head for drilling in soil by means of a multi-stage process, comprising:

a housing; and a drilling head tip, having an outwardly directed end for contacting the soil during drilling, arranged in the housing;

an adapter arranged on the drilling head tip forward of the housing with respect to forward movement of the drilling head;

a removable spacer arranged between the housing and the adapter and configured for installation on the drilling head tip to place the drilling head tip in contact with the housing in order to change the multi-stage process to a process with a reduced number of stages;

wherein the adapter is removable for insertion and removal of the spacer.

2. The drilling head according to claim 1, wherein the spacer abuts against a front area of the housing.

3. The drilling head according to claim 1, wherein the drilling head tip is prestressed by means of the spacer.

4. The drilling head according to claim 1, wherein the spacer comprises an elastic plastic.

5. The drilling head according to claim 1, wherein the spacer is arranged in a ring around the drilling head tip.

6. The drilling head according to claim 1, wherein the spacer is formed of a plurality of parts.

7. In a self-propelled drilling head designed for underground drilling in soil according to a multi-stage process, the drilling head having a housing and a drilling head tip arranged in the housing, a method comprising:

using a spacer in the self-propelled drilling head on the drilling head tip during underground drilling in soil, by means of which the drilling head tip is in contact with the housing in order to use the drilling head in an underground drilling method with a reduced number of stages, wherein, in one of the reduced number of stages, a percussion piston strikes both the drilling head tip and the housing.

8. A method for retrofitting a self-propelled drilling head for drilling underground in soil according to a multi-stage process, the drilling head having a housing and a drilling head tip arranged in the housing, comprising opening the housing and inserting a spacer, closing the housing to cause the spacer to come in contact with the drilling head tip and the housing in order to modify the multi-stage process of underground drilling by reducing the number of stages, wherein, in one of the reduced number of stages, a percussion piston strikes both the drilling head tip and the housing.

* * * * *